US006131777A

United States Patent [19]

Warby

[11] Patent Number: 6,131,777

[45] Date of Patent: Oct. 17, 2000

[54] SEAL ARRANGEMENTS FOR PRESSURIZED DISPENSING CONTAINERS

[75] Inventor: Richard John Warby, Wisbech, United Kingdom

[73] Assignee: Bespak plc, Norfolk, United Kingdom

[21] Appl. No.: 09/056,088

[22] Filed: Apr. 7, 1998

[30] Foreign Application Priority Data

Apr. 7, 1997 [GB] United Kingdom ..... 9707010

[51] Int. Cl.[7] ..... B65D 83/00

[52] U.S. Cl. ..... 222/402.2; 222/402.1

[58] Field of Search ..... 222/402.1, 402.2, 222/402.24

[56] References Cited

U.S. PATENT DOCUMENTS

| | | | |
|---|---|---|---|
| 3,081,917 | 3/1963 | Quercia . | |
| 3,510,030 | 5/1970 | Graham et al. . | |
| 5,037,012 | 8/1991 | Langford | 222/402.2 |
| 5,249,701 | 10/1993 | Daehn . | |
| 5,326,002 | 7/1994 | Dubini | 222/402.1 |
| 5,769,283 | 6/1998 | Owada et al. . | |
| 5,775,321 | 7/1998 | Alband | 222/402.1 X |

FOREIGN PATENT DOCUMENTS

| | | |
|---|---|---|
| 0 726 081 | 8/1996 | European Pat. Off. . |
| 1 203 920 | 1/1960 | France . |
| 1 299 724 | 12/1962 | France . |
| 1 562 567 | 4/1969 | France . |
| 798 683 | 7/1958 | United Kingdom . |
| 2 306 278 | 5/1997 | United Kingdom . |
| WO94 25373 | 11/1994 | WIPO . |
| WO96 32344 | 10/1996 | WIPO . |
| WO97/18146 | 5/1997 | WIPO . |

*Primary Examiner*—Kevin Shaver
*Assistant Examiner*—T Bui
*Attorney, Agent, or Firm*—Smith Gambrell & Russell, LLP

[57] ABSTRACT

The invention relates to pressurised dispensing apparatus which includes a container for product to be dispensed, and a valve for controlling outflow of product from the container. The valve includes a valve body located within the container. The container has an open ended container body, and a closure fixedly attached to said container body for closing the open end thereof. The closure has an annular sidewall extending around at least an upper end of the container body. First and second seals are provided, wherein the first seal provides a barrier against the ingress of moisture into the container and the second seal provides a barrier against leakage of the product from the container.

21 Claims, 5 Drawing Sheets

SEAL ARRANGEMENTS FOR PRESSURIZED DISPENSING CONTAINERS

Figure 1:
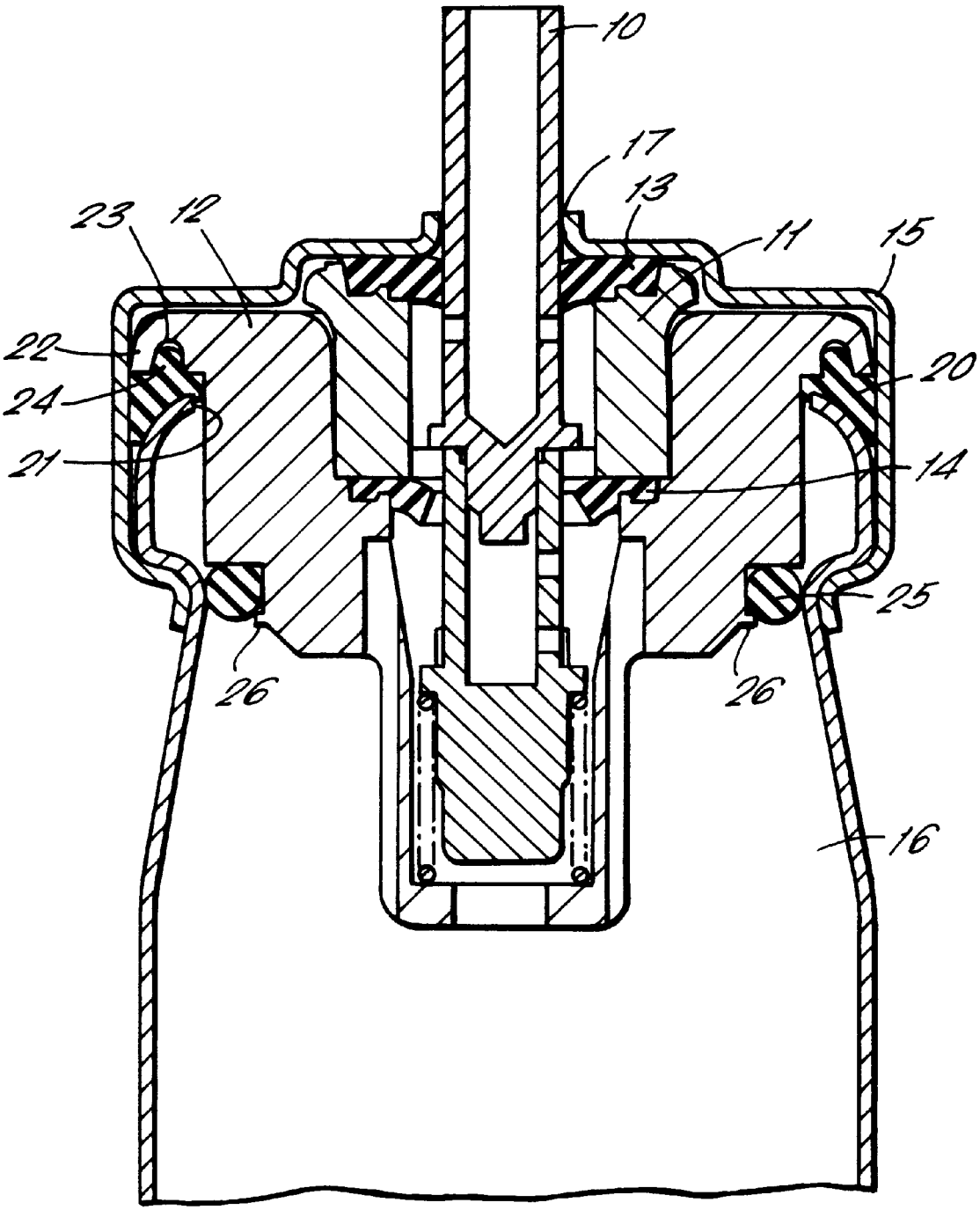

The invention relates to pressurised dispensing containers with an improved seal arrangement.

Pressurised dispensing containers are used for dispensing a wide variety of products from mobile to viscous liquid products, powdered products and the like and typically employ a liquid propellant such as a hydrocarbon or fluocarbon having sufficiently high vapour pressure at normal working temperatures to propel the product through the dispensing apparatus. These are commonly used for dispensing pharmaceuticals and medicaments.

Generally such pressurised dispensing containers comprise a container, a dispensing valve and a closure which is crimped to the container to hold the valve in place. A seal, usually made of an elastomeric material, is compressed between the container and the closure to prevent leakage of the contents. The efficiency of the sealing arrangement is particularly important to prevent the leakage of propellants. Although such leakage from medicinal aerosols no longer causes environmental and safety hazards if the new HFA propellants used which are environmentally friendly, where CFC propellants are used it is vital to prevent leakage to avoid such hazards. For all aerosols, regardless of the propellants used, it is also important that leakage of the contents of the dispensing containers is minimal to prevent loss of contents ensuring that sufficient is available after storage to meet label claims and that the ratio of propellant to product remains constant.

It has also hitherto been a problem that the permeability of the seal materials with respect to the propellants has led to loss of propellant during storage of the container and during shelf-life of the product.

To overcome such problems it has been proposed to use two seals, both of which are sandwiched between the container and the closure. An example of such proposal is described in International patent specification WO94/25373.

An improvement on this arrangement is described in our co-pending application No. GB 9523457.1. In this arrangement a primary seal is located between the container body and the closure, whilst a secondary seal is located between the valve body and the container.

Such systems have been effective in preventing leakage of propellant by virtue of their geometry, although improvements in the seal materials which are now available have resulted in materials which are more resistant to propellant leakage through the material itself. However, a further problem has come to light, that of the ingress of moisture through the valve-to-container seal.

It is an object of the present invention to provide a further improved sealing arrangement for pressurised dispensing containers to restrict or prevent moisture ingress.

According to the invention there is therefore provided pressurised dispensing apparatus comprising a container for product to be dispensed, valve means for controlling outflow of product from the container, said valve including a valve body located within the container, said container comprising an open ended container body and a closure fixedly attached to said container body for closing the open end thereof, said closure having an annular sidewall extending around at least an upper end of the container body, said apparatus further comprising first and second seals, wherein the first seal provides a barrier against the ingress of moisture into the container and the second seal provides a barrier against leakage of the product from the container.

Preferred embodiments of the present invention will now be described, by way of example only, with reference to the accompanying drawings in which FIGS. 1 to 5 illustrate a cross-sectional elevation of a metering valve known in the prior art for use in a pressurising dispensing container incorporating alternative seal arrangements according to the present invention.

Figure 2:
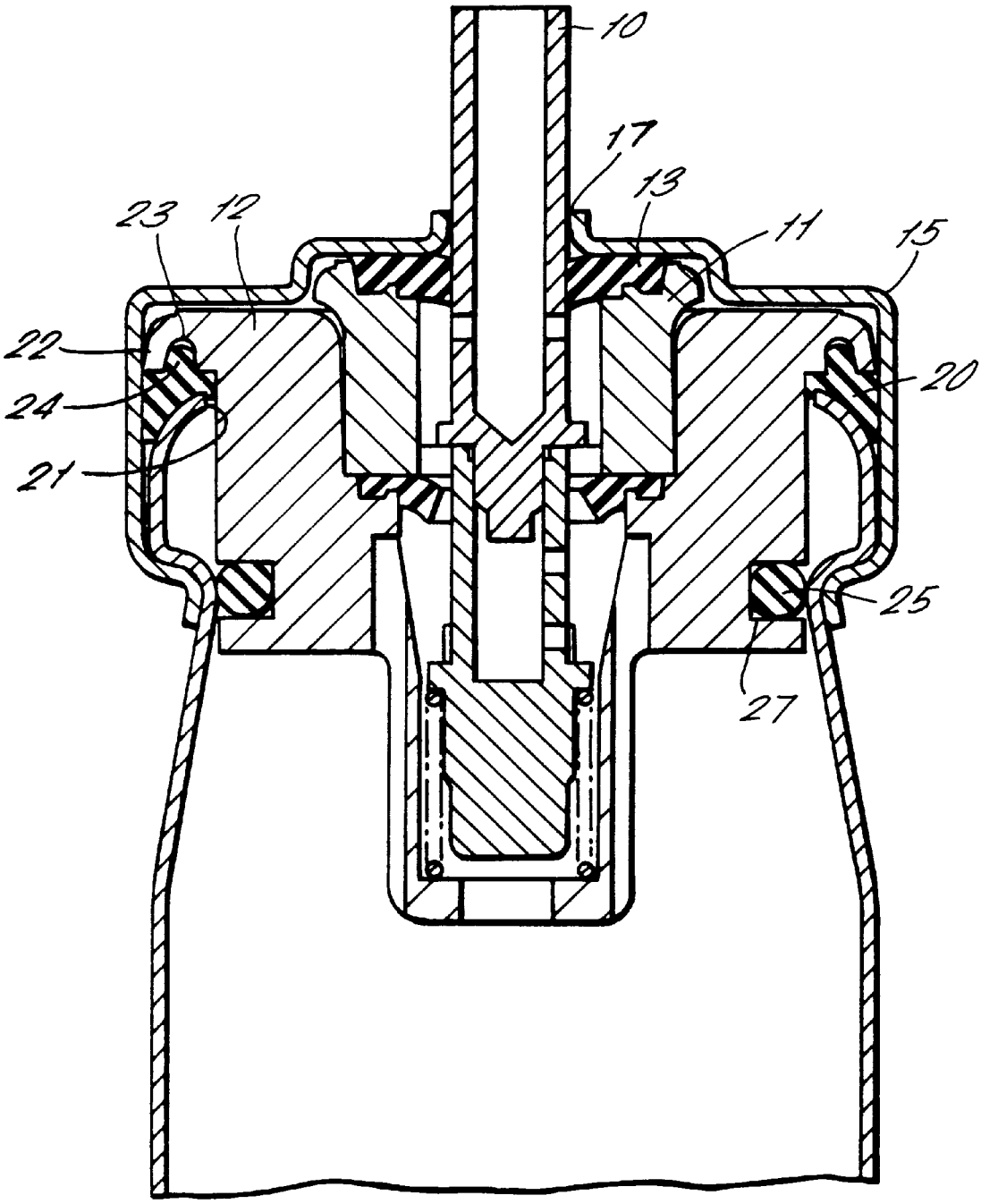

Referring to FIGS. 1 and 2 a metering valve comprises a valve member in the form of a valve stem 10 which is axially slidable within an annular metering chamber 11. The metering chamber 11 and a portion of the valve stem 10 are located within a valve body 12. An outer seal 13 and an inner seal 14 extend radially between the valve stem 10 and the chamber 11. The outer seal 13 is sandwiched between an upper end of the metering chamber 11 and a closure or ferrule 15 which is crimped to a container body 16 covering an open end thereof, thus providing a closed container holding the product to be dispensed. The closure 15 has a central aperture 17 through which the valve member 10 extends. Depression of the valve stem 10 causes the product to exit the container 16 from the chamber 11 through a passageway in the valve stem 10. The specific form and mode of operation of the metering valve may be selected as required.

The first seal 20 or the seal arrangement of the present invention is located between an external surface of the upper end of the container body 16 and an inner surface of an annular sidewall of the closure 15. In the embodiments of the invention shown in FIGS. 1 and 2, the first seal 20 is provided by a gasket in sealing engagement with and compressed between the rim forming the annular opening 21 of the container body 16 and a radially extended flanged section 22 of the valve body 12 extending between a main body portion and the sidewall of the closure 15. The first seal 20 could be located in the annular groove in an external surface of the container body. In FIG. 2, the seal 20 has a portion 24 which protrudes into a groove 23 in the valve body 15.

The first seal 20 is preferably made of an ethylene-propylene-DM rubber (EPDM), a nitrile rubber or neoprene. These materials have a very high resistance to propellants such as HFC-134a, HFC-227 and ethanol and products containing these propellants and thus the first seal 20 prevents leakage of products incorporating those propellants from the container body 16.

A second seal 25, shown in FIGS. 1 and 2 as an O-ring, is provided in sealing engagement with an internal surface of the container body 16, preferably at a neck portion thereof, and the valve body 12. The second seal 25 may be retained by locating or retention nodules 26 as illustrated in FIG. 1 or within an annular groove 27 in the valve body 12 as illustrated in FIG. 2.

This second seal 25 is made of a material which has low moisture and air permeability characteristics and therefore provides a barrier against the ingress of moisture into the main body of the container. Any appropriate material may be used which has low moisture and air permeability characteristics such as ethylene-propylene-DM rubber, ethylene-propylene-M rubber, styrene butadiene, fluorosilicone, silicone, polyethylene, EVA, nitrile rubber or butyl.

The second seal 25 additionally helps to seal off the main body of the container body 16 from the first seal 20.

Figure 3:
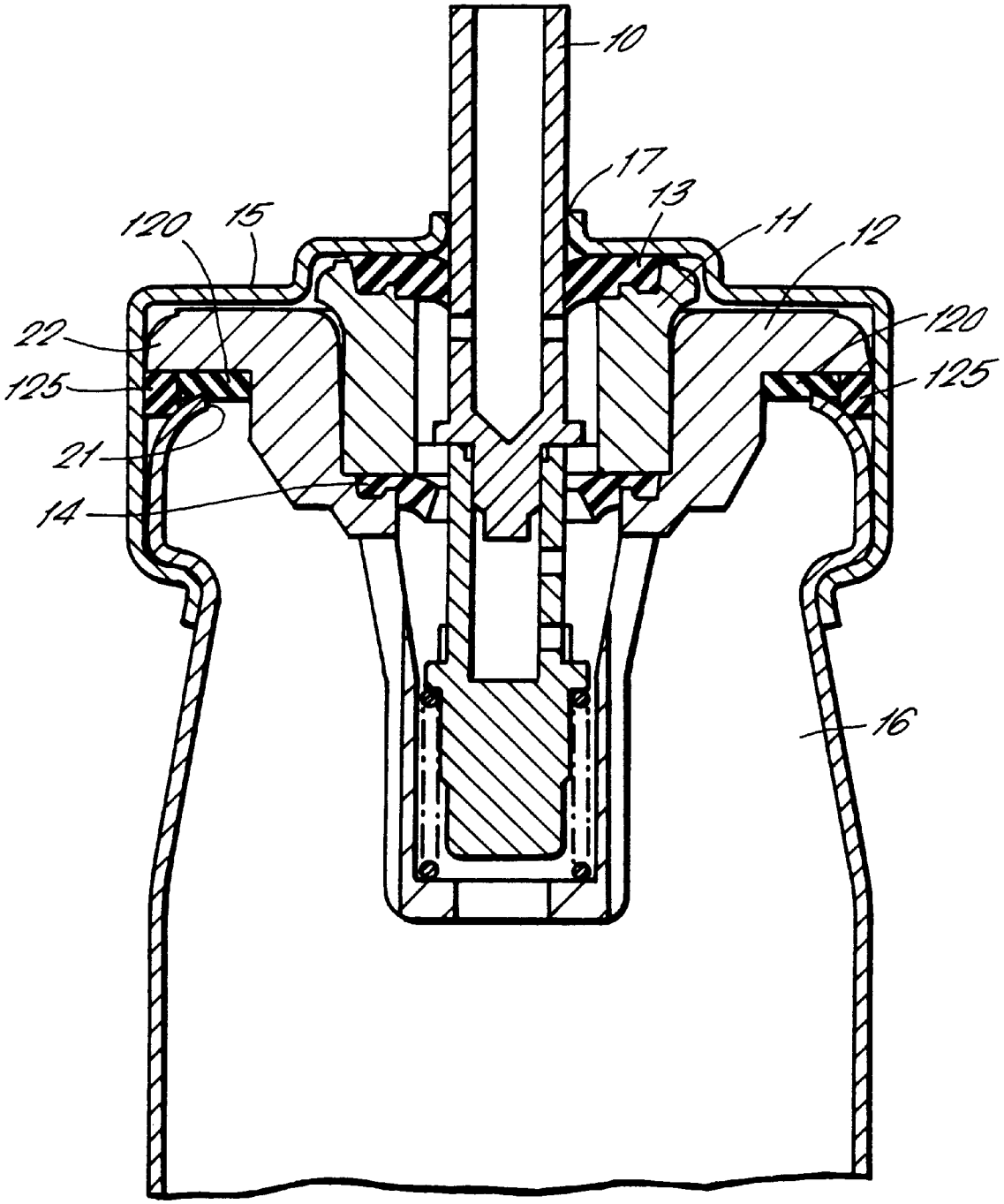

Referring now to FIG. 3, the parts corresponding to the embodiment of FIG. 1 and FIG. 3 are numbered similarly. However, whereas the first and second seal 20, 25 are arranged remotely from each other in FIG. 1 or FIG. 2, they are arranged adjacent and in sealing contact with each other in FIG. 3. The first and second seals may be independent members as before or two sealing elements of a single seal member having two sealing elements. The second (moisture) seal 125 in this embodiment is positioned outside the first seal 120 in this embodiment as it is not the seal which is compressed between the container body 16 and the valve body flange 22. The second (moisture) seal 120 is in sealing contact with a section of an upper end of the container body 16, although not with the annular opening 21 of the container body 16. The second (moisture) seal 125 is also in sealing contact with the inner surface of the closure 15 and the flanged section 22 of the valve body 12. The first (propellant) seal 120 is in sealing contact with the flanged section 22 of the valve body 12 and the annular opening 21 of the container 16 and is compressed therebetween as well as in contact with the second (moisture) seal 125. Thus the first (propellant) seal 120 has the secondary purpose of isolating the second (moisture) seal 125 from the main pressure within the container body 16 and the product contained therein.

Figure 4:
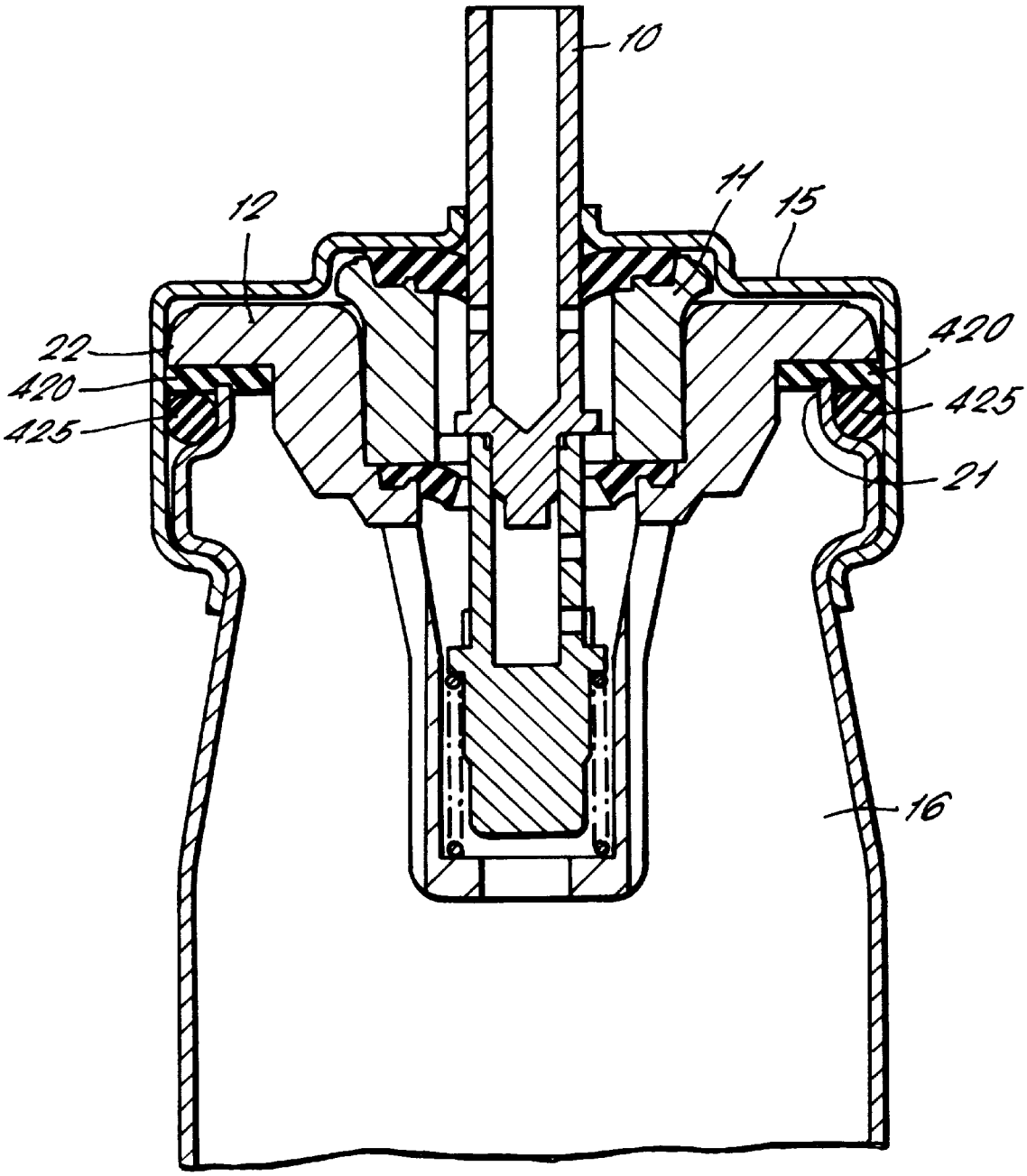

In FIG. 4 yet another embodiment of the present invention is illustrated. In this embodiment, the second (moisture) seal 425 is provided by an O-ring located in a retaining collar formed by the upper end of the container body 16 adjacent the annular opening 21. The first (propellant) seal 420 being the compressed seal, is in sealing contact with the second seal 425, the closure 15 and the valve body 12. In this embodiment the first (propellant) seal 420 isolates the second (moisture) seal 425 from the pressure and contents of the container body 16.

Figure 5:
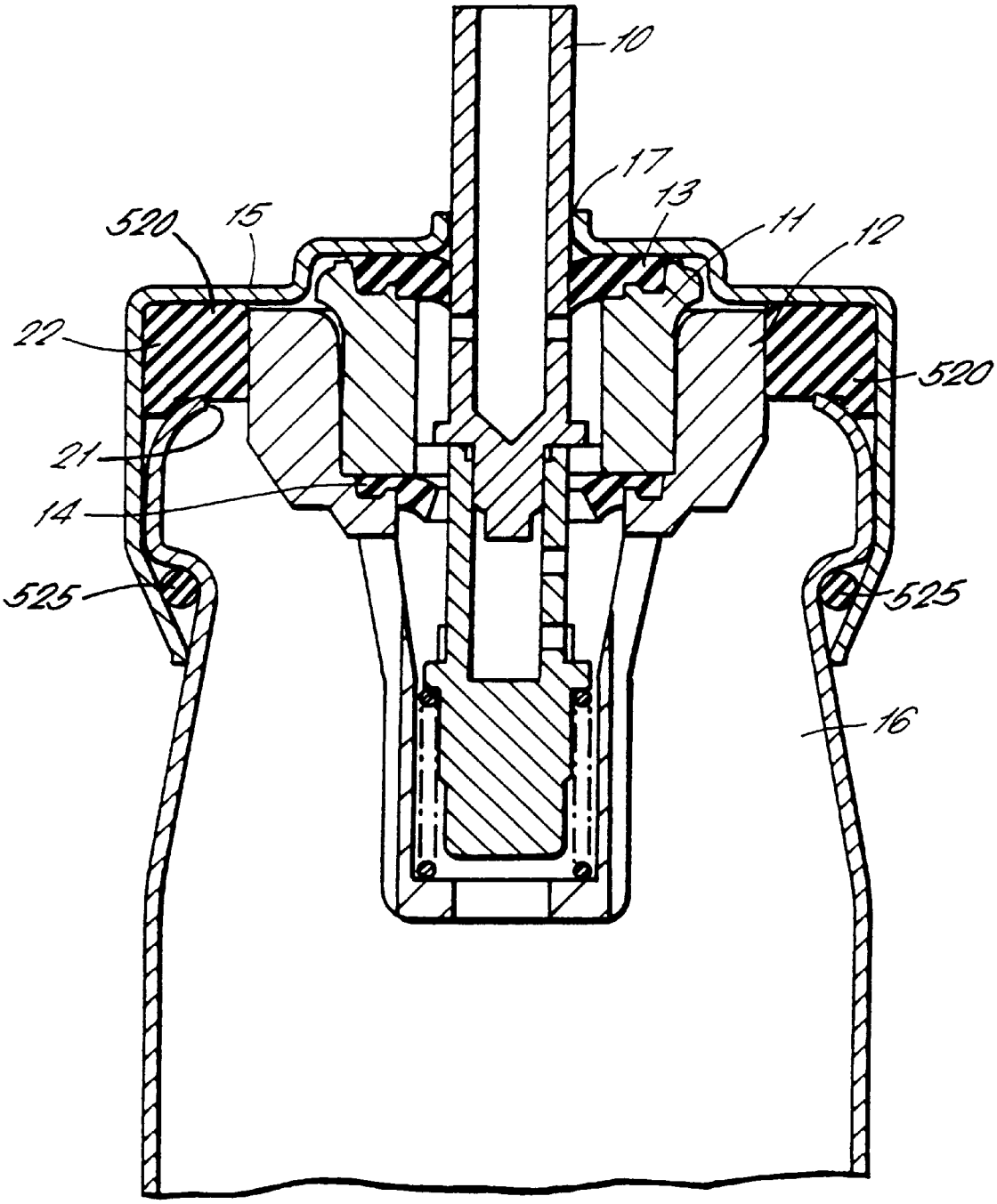

In FIG. 5, another embodiment of the present invention is illustrated. In this embodiment, the second (moisture) seal 525 is provided by an O-ring located between the exterior of the container body 16 and an inner surface of the closure 15. The first (propellant) seal 520, in the form of a gasket, is in sealing engagement with and compressed between the rim forming the annular opening 21 of the container body 16 and the closure 15. Thus the closure 15 and container body 16 are in opposing sealing engagement with each of the first and second seals 520, 525.

Although the first seal is preferably under compression between the container body 16 and the flange 22 of the valve body 12, this is not absolutely necessary as long as it provides an effective seal against leakage of the pressurised contents of the container.

What is claimed is:

1. A pressurized dispensing apparatus comprising a container for product to be dispensed, valve means for controlling outflow of product from the container, said valve including a valve body located within the container, said container comprising an open ended container body and a closure fixedly attached to said container body for closing the open end thereof, said closure having an annular sidewall extending around at least an upper end of the container body, said apparatus further comprising first and second seals, said second seal being a barrier against the ingress of moisture into the container, said first seal being a barrier against leakage of the product from the container, wherein one of the seals is located in sealing engagement between the container body and the closure and the other seal is located in sealing engagement between the valve body and the container.

2. Pressurised dispensing apparatus as claimed in claim 1 in which the second seal is made from a material which has a low permeability to air and moisture.

3. Pressurised dispensing apparatus as claimed in claim 1 in which the second seal is made of ethylene-propylene-DM rubber, ethylene-propylene-M rubber, styrene butadiene, fluorosilicone, silicone, polyethylene, EVA, nitrile rubber or butyl.

4. Pressurised dispensing apparatus as claimed in claim 1 in which the first seal has a low permeability to the product.

5. Pressurised dispensing apparatus as claimed in claim 1 in which the material of the first seal is an ethylene-propylene-DM rubber, a nitrile rubber or neoprene.

6. Pressurised dispensing apparatus as claimed in claim 1 in which one of the seals is located in sealing engagement between the valve body and the container body.

7. Pressurised dispensing apparatus as claimed in claim 1 in which one of the seals is located in sealing engagement between the valve body and the closure sidewall.

8. Pressurised dispensing apparatus as claimed in claim 1 in which the first and second seals comprise independent seal members.

9. Pressurised dispensing apparatus as claimed in claim 1 in which at least one of the seals is an O-ring.

10. Pressurised dispensing apparatus as claimed in claim 1 in which the valve body has an external surface, and the second seal is located in an annular groove in said external surface of the valve body.

11. Pressurised dispensing apparatus as claimed in claim 1 in which one of the seals is held in position on the valve body by means of locating nodules.

12. Pressurised dispensing apparatus as claimed in claim 1 in which the first and second seals are located adjacent to and in sealing contact with each other.

13. Pressurised dispensing apparatus as claimed in claim 1 in which the first and second seals are provided by a single seal member having two sealing elements.

14. Pressurised dispensing apparatus as claimed in claim 1 in which both seals are in sealing engagement with the valve body.

15. Pressurised dispensing apparatus as claimed in claim 1 in which both seals are in sealing engagement with both the container body and the closure.

16. Pressurised dispensing apparatus as claimed in claim 1 in which the first seal is located in an annular groove in an external surface of the container body.

17. Pressurised dispensing apparatus as claimed in claim 1 in which the valve body has a radially extended flange extending between a main body portion and the sidewall of the closure.

18. Pressurised dispensing apparatus as claimed in claim 17 in which a transverse face of the flange provides a seal for engagement with at least one of the seals.

19. Pressurised dispensing apparatus as claimed in claim 17 including a further seal between the valve body and the closure, said flange providing said further seal.

20. Pressurised dispensing apparatus as claimed in claim 1 in which the closure and container body are in opposed sealing engagement with each of the first and second seals.

21. Pressurised dispensing apparatus as claimed in claim 1 in which the first seal is under compression between the valve body and container body.

* * * * *